US011553783B2

(12) United States Patent
Ohayon

(10) Patent No.: US 11,553,783 B2
(45) Date of Patent: Jan. 17, 2023

(54) INTERCHANGEABLE BROOM BRISTLE WITH RELEASABLE AGENT

(71) Applicant: Jacob Koby Ohayon, North Miami, FL (US)

(72) Inventor: Jacob Koby Ohayon, North Miami, FL (US)

( * ) Notice: Subject to any disclaimer, the term of this patent is extended or adjusted under 35 U.S.C. 154(b) by 375 days.

(21) Appl. No.: 16/846,053

(22) Filed: Apr. 10, 2020

(65) Prior Publication Data

US 2021/0137255 A1 May 13, 2021

Related U.S. Application Data

(60) Provisional application No. 62/932,520, filed on Nov. 8, 2019.

(51) Int. Cl.

| | |
|---|---|
| ***A46B 5/00*** | (2006.01) |
| ***A46B 9/02*** | (2006.01) |
| ***A46D 1/00*** | (2006.01) |
| ***A47L 13/12*** | (2006.01) |

(52) U.S. Cl.

CPC ..... *A46B 5/0095* (2013.01); *A46D 1/006* (2013.01); *A47L 13/12* (2013.01); *A46B 9/02* (2013.01); *A46B 9/025* (2013.01); *A46B 2200/302* (2013.01); *A46D 1/0253* (2013.01)

(58) Field of Classification Search

CPC ... A46B 5/0095; A46B 2200/302; A46B 9/02; A46B 9/025; A46B 9/028; A46B 9/06; A46D 1/006; A46D 1/00; A46D 1/02; A46D 1/0253; A47L 13/12; A47L 13/60

USPC ..... 15/104.93, 159.1, 176.1, 207.2; 401/268, 401/274, 282, 290

See application file for complete search history.

(56) References Cited

U.S. PATENT DOCUMENTS 2,614,282 A 10/1952 Roman
3,087,223 A * 4/1963 Raw ..... D06C 11/00 15/207.2

(Continued)

FOREIGN PATENT DOCUMENTS

CN 202761208 U 3/2013
JP H057510 A 1/1993

(Continued)

OTHER PUBLICATIONS

English Translation of patent document CN202761208 obtained from Patent Translate of the website of the European Patent Office.

(Continued)

*Primary Examiner* — David J Walczak
(74) *Attorney, Agent, or Firm* — Michael Porco

(57) ABSTRACT

An interchangeable broom bristle with at least one releasable agent. The broom bristles may be part of a broom including a handle and a broom head. The bristles are adapted to include at least one agent, which when the broom is in use the at least one agent is released. The agent may be a perfume or the like which releases a scent via friction when adjacent bristles come into contact with each other. The agent may include an anti-bacterial composition and/or a cleaning agent. Additionally, the broom head may be adapted to be interchangeable. The bristles may take various forms and the bristle head may include at least one type or form of bristle and/or any combination of at least two types or forms of bristle.

20 Claims, 7 Drawing Sheets

(56) References Cited

U.S. PATENT DOCUMENTS

| | | | | |
|---|---|---|---|---|
| 4,244,168 | A * | 1/1981 | Howard | A01D 7/06 15/207.2 |
| 5,985,192 | A | 11/1999 | Weihrauch | |
| 6,108,847 | A | 8/2000 | Cueman et al. | |
| 6,207,274 | B1 | 3/2001 | Ferenc et al. | |
| 6,701,567 | B2 | 3/2004 | Smith | |
| 6,991,842 | B2 | 1/2006 | Hurwitz | |
| 7,322,364 | B2 | 1/2008 | Hurwitz | |
| 7,503,093 | B2 | 3/2009 | Weihrauch | |
| 7,594,344 | B2 | 9/2009 | Mizrahi | |
| 7,832,413 | B2 | 11/2010 | Walters et al. | |
| 7,976,235 | B2 | 7/2011 | Hoadley et al. | |
| 8,173,857 | B1 | 5/2012 | Yananton | |
| 8,984,697 | B2 | 3/2015 | Knopow et al. | |
| 10,188,202 | B1 | 1/2019 | Cincotta | |
| 10,398,280 | B2 | 9/2019 | Krebs et al. | |
| 2003/0200980 | A1 | 10/2003 | LeGassie | |
| 2004/0211018 | A1* | 10/2004 | Canton | A46D 1/0292 15/207.2 |
| 2005/0132520 | A1 | 6/2005 | Navarro | |
| 2005/0204493 | A1 | 9/2005 | Legus et al. | |
| 2007/0113365 | A1 | 5/2007 | Parkinson | |
| 2007/0180637 | A1 | 8/2007 | McKay | |
| 2008/0189887 | A1 | 8/2008 | Vosbikian et al. | |
| 2009/0100621 | A1 | 4/2009 | Niizaki et al. | |
| 2010/0163067 | A1 | 7/2010 | Wynne | |
| 2015/0359323 | A1 | 12/2015 | Clift et al. | |
| 2021/0353047 | A1* | 11/2021 | König | A46D 3/08 |
| 2022/0064978 | A1* | 3/2022 | Saccoccio | A46D 1/0207 |

FOREIGN PATENT DOCUMENTS

| | | | |
|---|---|---|---|
| JP | 2008012127 | A | 1/2008 |
| WO | 2000002467 | A1 | 1/2000 |

OTHER PUBLICATIONS

English Translation of patent document JP2008012127 obtained from Patent Translate of the website of the European Patent Office.
English Translation of patent document JPh057510 obtained from Patent Translate of the website of the European Patent Office.

* cited by examiner

INTERCHANGEABLE BROOM BRISTLE WITH RELEASABLE AGENT

PRIORITY

This application claims priority on U.S. Provisional Patent Appl. No. 62/932,520 filed Nov. 8, 2019, entitled "INTERCHANGEABLE BROOM BRISTLE WITH RELEASABLE AGENT", the contents of which are hereby incorporated by reference in its entirety.

BACKGROUND

Field

The present disclosure generally relates to cleaning devices, and more particularly, to an interchangeable broom bristle with releasable agent.

Description of the Related Art

Brooms are common cleaning devices that have been used for hundreds if not thousands of years. Bundles of natural material such as twigs, grass, and corn husks were used in ancient times to clean floors and hearth areas. A popular material for making brooms were branches of the broom plant, a yellow flowering shrub. As civilization advanced, broom making became a skilled trade with artisans known as "besom squires" in Anglo-Saxon England. Besom being the name for a cleaning tool consisting of a bundle of sticks or twigs used to whisk dirt away.

In the United States, a species of Sorghum known as broomcorn became the standard material for brooms in the northeastern United States, and an industry was born. The Shakers, a Christian religious sect that excelled at handicrafts, perfected various broom styles including the flat broom and the whisk broom.

With modern day materials such as plastics, many brooms are now made entirely from plastic. Whether natural fibers or plastic are used, over time the bristles of a broom will wear down, bend, deform, and break off, necessitating the need to replace the entire broom and/or the broom head.

In addition to sweeping debris or trash with a broom to clean a surface, an agent, e.g., an antimicrobial agent, cleaning agent, scent liquid, is typical applied to the surface after the sweeping process to, for example, further clean the surface, disinfect the surface, etc. Therefore, a need exists for techniques for applying an agent to a surface while sweeping with a broom or the like.

SUMMARY

An interchangeable broom bristle with releasable agent is provided. The broom bristles may be part of a broom including a handle and a broom head. The bristles are adapted to include at least one agent, which when the broom is in use the at least one agent is released. For example, the agent may be a perfume or the like which releases a scent via friction when adjacent bristles come into contact with each other. The agent may include an anti-bacterial composition and/or a cleaning agent. Additionally, the broom head may be adapted to be interchangeable.

According to one aspect of the present disclosure, a broom is provided including an elongated handle having a first end and a second end; a broom head including a receiver for coupling the broom head to the second end of the elongated handle and a plurality of bristles extending from the broom head; and an agent applied to at least one bristle of the plurality of bristles.

In one aspect, the agent is at least one of an antibacterial agent, a scented agent and/or a cleaning agent.

In another aspect, the agent is at least one of a liquid, solid, and/or gas.

In a further aspect, the agent is encapsulated by a membrane, wall and/or coating.

In one aspect, at least two different agents are applied to the at least one bristle.

In yet another aspect, the at least two different agents are each separately applied to each of the at least one bristle in different regions.

In one aspect, at least one bristle of the plurality of bristles is substantially straight.

In another aspect, at least bristle of the plurality of bristles includes an elongated member and at least one side member coupled to and extending away from the elongated member.

In yet another aspect, the at least one elongated member bristle with the at least one side member bristle and the at least one second substantially straight bristle are arranged in alternating rows and/or columns.

In a further aspect, at least one bristle of the plurality of bristles is substantially helix shaped.

In another aspect, the at least one substantially helix shaped bristle and the at least one second substantially straight bristle are arranged in alternating rows and/or columns.

In still a further aspect, at least one bristle of the plurality of bristles includes at least one bend of a non-zero angle.

In yet another aspect, the at least one bristle including the at least one bend and the at least one second substantially straight bristle are arranged in alternating rows and/or columns.

In one aspect, the at least one bend of the non-zero angle is in the range of about 110 degrees to about 170 degrees.

In a further aspect, the at least one bristle includes a plurality of bends.

BRIEF DESCRIPTION OF THE DRAWINGS

The above and other aspects, features, and advantages of the present disclosure will become more apparent in light of the following detailed description when taken in conjunction with the accompanying drawings in which.

Figure 1:
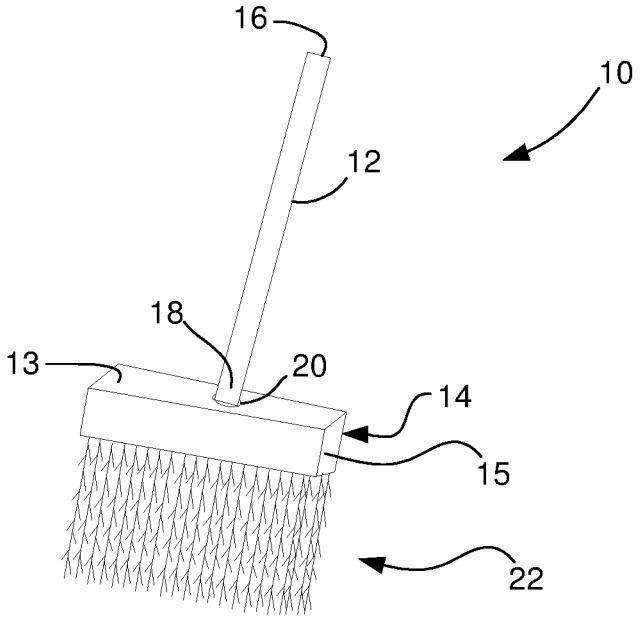
FIG. 1 is a perspective view of a broom in accordance with the present disclosure.

It should be understood that the drawing(s) are for purposes of illustrating the concepts of the disclosure and is not necessarily the only possible configuration for illustrating the disclosure.

DETAILED DESCRIPTION

Embodiments of the present disclosure will be described herein below with reference to the accompanying drawings. In the following description, well-known functions or constructions are not described in detail to avoid obscuring the present disclosure in unnecessary detail. The word "exemplary" is used herein to mean "serving as an example, instance, or illustration." Any configuration or design described herein as "exemplary" is not necessarily to be construed as preferred or advantageous over other configurations or designs. Herein, the phrase "coupled" is defined to mean directly connected to or indirectly connected with through one or more intermediate components.

Figure 2:
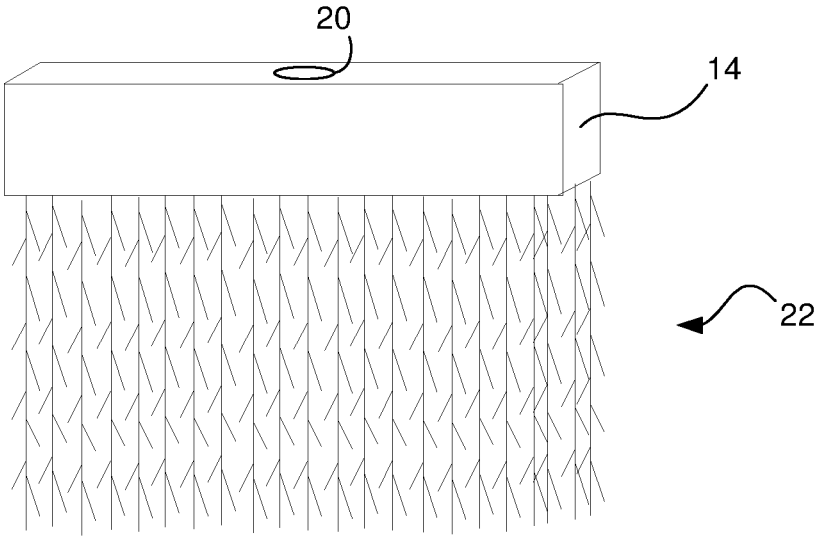
FIG. 2 is a front view of broom head in accordance with an embodiment of the present disclosure.
Figure 12:
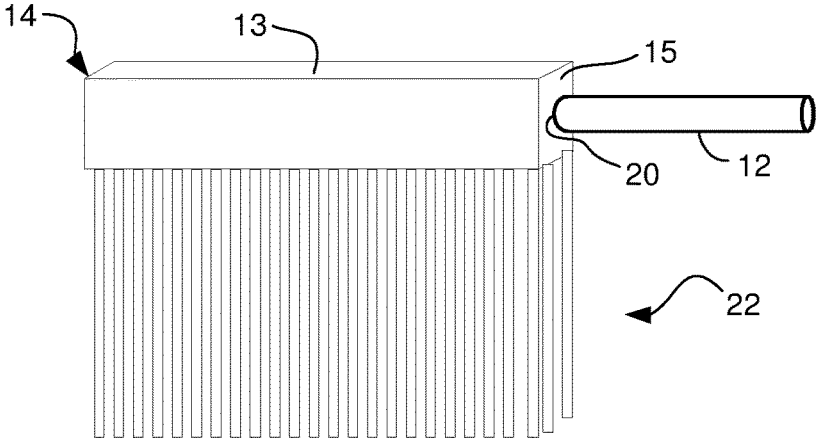
FIG. 12 is a perspective view of a broom in accordance with the present disclosure.

Referring to FIGS. 1 and 2, a broom 10 in accordance with an embodiment of the present disclosure is provided. The broom 10 includes a handle 12 and a broom head 14. The handle 12 is elongated and generally cylindrical with a first end 16 and a second end 18. It is to be appreciated that other geometries for handle 12 (e.g., curved) are contemplated to be within the scope of the present disclosure. The broom head 14 includes a top surface 13, at least one side surface 15 and a receiver 20 on the top surface 13 (e.g., a threaded channel, or other type of receiver) for coupling the broom head 14 to the second end 18 (e.g., including threading or other coupling means corresponding to receiver 20) of the elongated handle 12. In another embodiment, as shown in FIG. 12, the receiver 20 may be disposed on the side surface 15 of broom head 14. A plurality of bristles 22 extend from the broom head 14.

Referring to FIGS. 3-6, each bristle 24 of the plurality of bristles 22 includes an elongated member 26, i.e., main or core bristle, having a first end 28 that attaches the bristle 24 to the broom head 14 and a second, free end 30 that makes contact with a surface to be cleaned. Bristle 24 further includes at least one side member 32, i.e., a side bristle, coupled to and extending away from the elongated member 26. It is to be appreciated that although elongated member 26 and side members 32 are shown as extending linearly in FIGS. 1-6, in other embodiments member 26 and/or members 32 may be configured in curved or other nonlinear geometries (e.g., having multiple bends, twists, etc.), as will be described below in relation to FIGS. 7A-11. Additionally, it is to be appreciated that the side members 32 may be coupled to member 26 so as to be generally in the direction from end 28 toward end 30; however, in other embodiments, the side members may be coupled to member 26 to be generally in the direction from end 30 to end 28 and/or in a plurality of directions.

Figure 3:
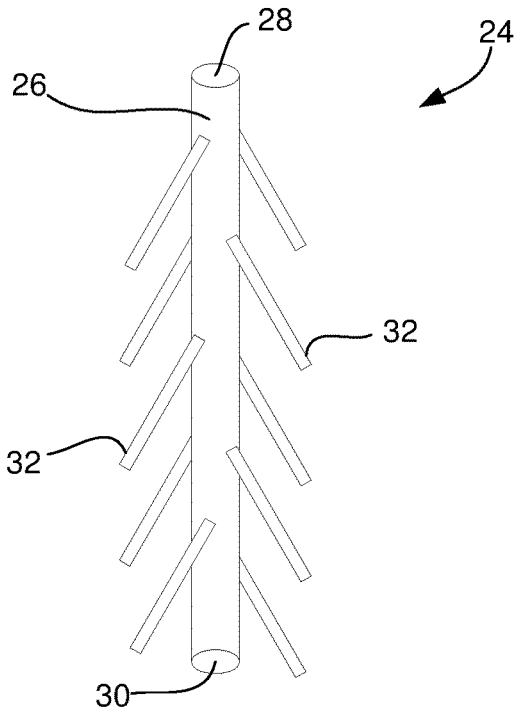
FIG. 3 illustrates a bristle in accordance with an embodiment of the present disclosure.

In one embodiment, an agent may be applied to the at least one side member 32, such that when side members 32 of adjacent bristles 24 come into contact with each other, the agent is released and provided to a surface to be cleaned. It is to be appreciated that the side members 32 are provided to increase an overall surface area of each bristle 24 so that each bristle 24 can carry an increased amount of agent. Also, as shown in FIGS. 1-6, each side members 32 extends at a predetermined non-zero angle from the member 26 that member 32 is coupled to, to increase the probability that members 32 from different bristles 24 contact each other to release the agent. It is further to be appreciated that although ten side members 32 are shown in FIG. 3 the number of side members is not limited to ten and may be more or less than ten.

Figure 4:
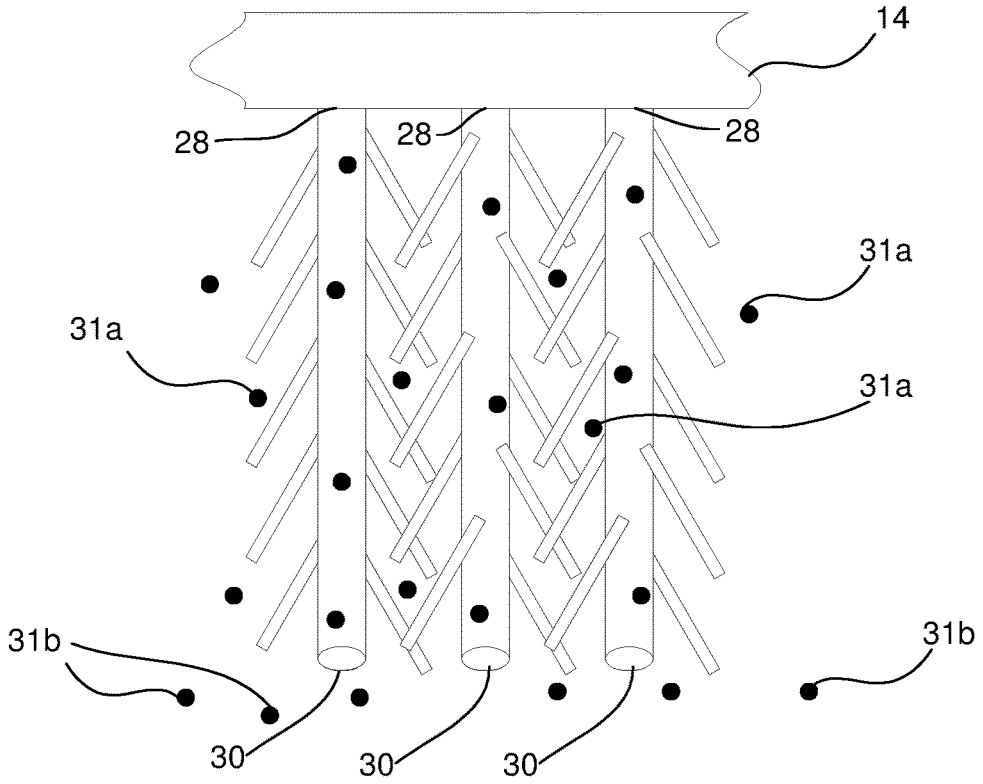
FIG. 4 illustrates an interaction of at least two bristles in accordance with an embodiment of the present disclosure.

In one embodiment, an agent may be applied to all surfaces of the bristle 24, i.e., the elongated member 26 and at least one side member 32, via various processes such as but not limited to, a dip-coating process, a spraying process, etc. It is to be appreciated that the agent may, in certain embodiments, just be applied to the side members or bristles 32. As shown in FIG. 4, when two adjacent bristles 24 are coupled to the broom head 14, the side members 32 of each bristle 24 interact or come into contact with each other. As stated above, this interaction is made more likely because each side member 32 extends at a predetermined non-zero angle relative to member 26. When the broom 10 is in use, the second end 30 of each bristle 24 comes into contact with a surface to be cleaned. Movement of the broom 10, and more particularly the broom head 14, causes the bristle 24 to move independently causing the side members 32 to interact with each other. When the side members 32 interact, friction created by the contacting side members will cause the agent to be release from the surface of the bristles 24. As shown in FIG. 4, some particles of the agent 31*a* may be released into the ambient air or surroundings and other particles of the agent 31*b* may fall to the surface being cleaned. It is to be appreciated that the particles may take many forms including a solid, liquid, gas, etc.

It is to be appreciated that in other embodiments the agent 31 may additionally be applied to the elongated member 26 such that the interaction of the side members 32 and any of the members 26 will cause the agent to be released.

Figure 5:
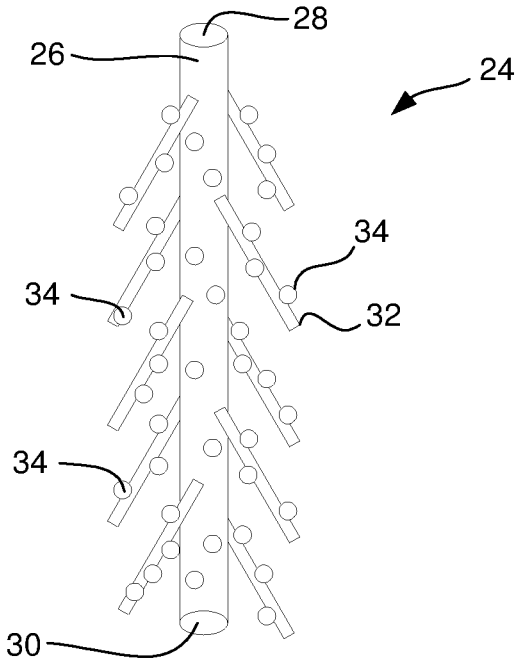
FIG. 5 illustrates a bristle with a releasable agent applied thereon in accordance with the present disclosure.

In another embodiment, the agent is micro-encapsulated and applied to the side members 32 as shown in FIG. 5. Each microcapsule 34 is a small sphere with a uniform wall around it, also known as a shell, coating, or membrane. Materials like lipids and polymers, such as alginate, may be used as a mixture to trap the agent of interest inside the wall. Other exemplary materials for the wall or coating may include ethyl cellulose, polyvinyl alcohol, gelatin and/or sodium alginate. It is to be appreciated that the microcapsules 34 may be applied to all surfaces of the bristle 24 including the main or core member 26.

Figure 6:
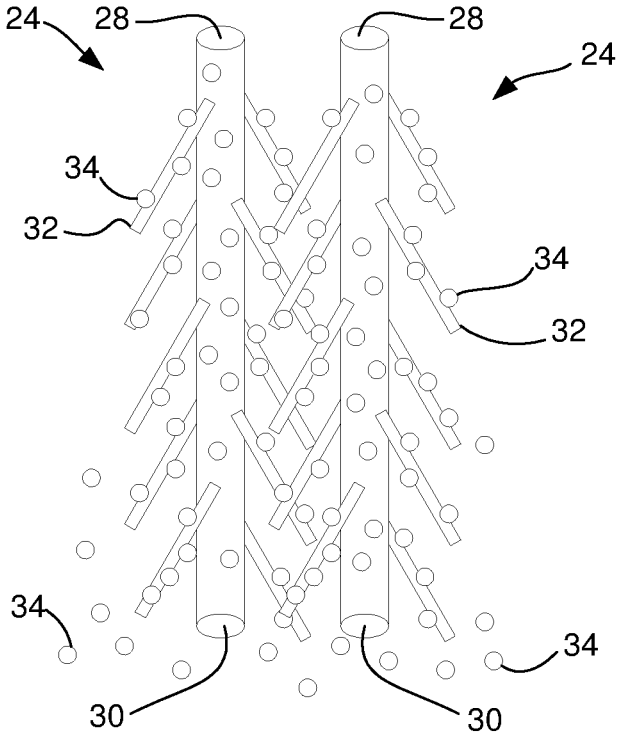
FIG. 6 illustrates an interaction of at least two bristles in accordance with another embodiment of the present disclosure.

As shown in FIG. 6, when two adjacent bristles 24 are coupled to the broom head 14, the side members 32 of each bristle 24 interact or come into contact with each other. As stated above, this interaction is made more likely because each side member 32 extends at a predetermined non-zero angle relative to member 26. When the broom 10 is in use, the second end 30 of each bristle 24 comes into contact with a surface to be cleaned. Movement of the broom 10, and more particularly the broom head 14, causes the bristle 24 to move independently causing the side members 32 to interact with each other. In one embodiment, when the side members 32 interact, the wall or coating of the microcapsules 34 will break releasing the agent. Additionally, some microcapsules may dislodge from the side members 32 and fall to the cleaning surface, as shown in FIG. 6. Subsequently, the microcapsules 34 that have fallen may break open to release the agent when the microcapsules 34 come into contact with the second end 30 of the bristles 24.

In one embodiment, the agent disposed in the microcapsule 34 may be a scented liquid such as a perfume.

In another embodiment, the agent may be an antimicrobial material such as silver zeolite, triclosan or other similar antimicrobial material.

In a further embodiment, the agent may be a cleaning agent such as, but not limited to, a degreaser, a detergent, a solvent, etc. In one embodiment, the agent may be an all-purpose cleanser which preferably includes mixtures of anionic and nonionic surfactants, polymeric phosphates or other sequestering agents, solvents, hydrotropic substances, polymeric compounds, corrosion inhibitors, skin-protective agents, and sometimes perfumes and colorants.

In another embodiment, the bristles 24 may include a plurality of microcapsules 34 that are a combination of the various agent described above. For example, a first portion of microcapsules 34 may include a scented agent and a second portion of microcapsules 34 may include an antimicrobial agent. In another example, a first portion of microcapsules 34 may include a cleaning agent and a second portion of microcapsules 34 may include a scented agent. The present disclosure contemplates that the plurality of microcapsules 34 applied to the bristle 24 may include various combinations of agents and is not limited by the brief examples given above.

It is to be appreciated that the various agents may be applied in separate and distinct layers across the plurality of bristles 22. In some embodiments, side members 32 more proximate to end 30 of each bristle 24 may include microcapsules 34 having an antimicrobial material, while side members 32 more proximate to end 28 of each bristle 24 may include microcapsules 34 having a scented agent. In this way, the surface that broom 10 is used with is treated with the antimicrobial material that is closest to end 32 of each bristle 24 and the ambient air proximate to head 14 is treated with the scented agent.

Figure 7A:
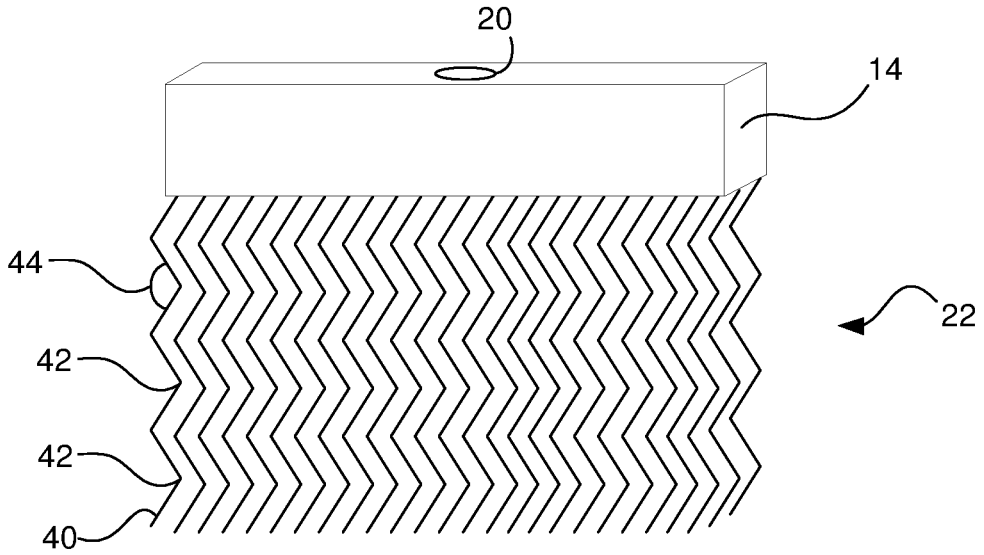
FIG. 7A is a perspective view of a broom head in accordance with an embodiment of the present disclosure.
Figure 7B:
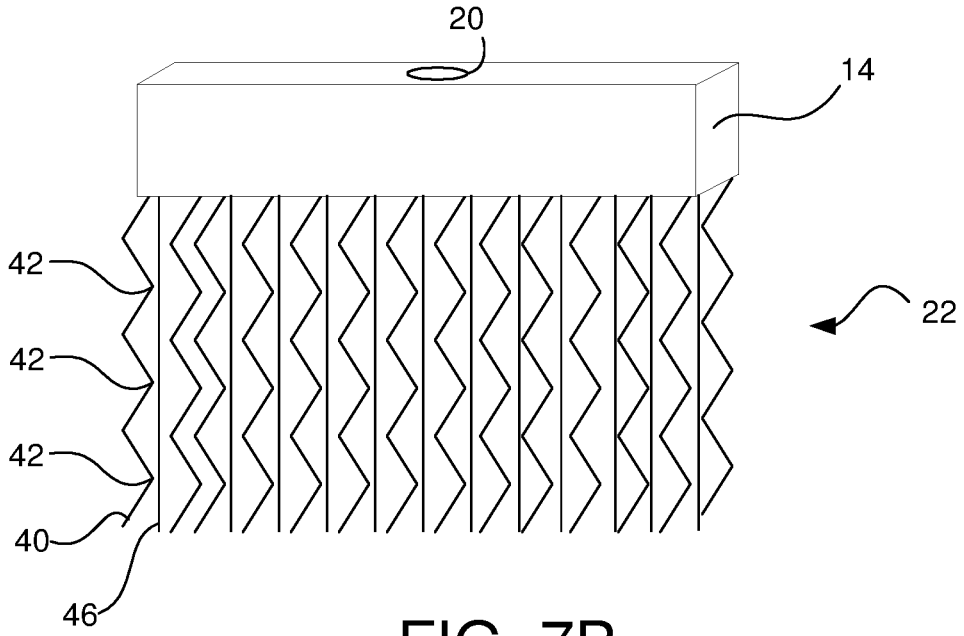
FIG. 7B is a perspective view of a broom head in accordance with an embodiment of the present disclosure.
Figure 8A:
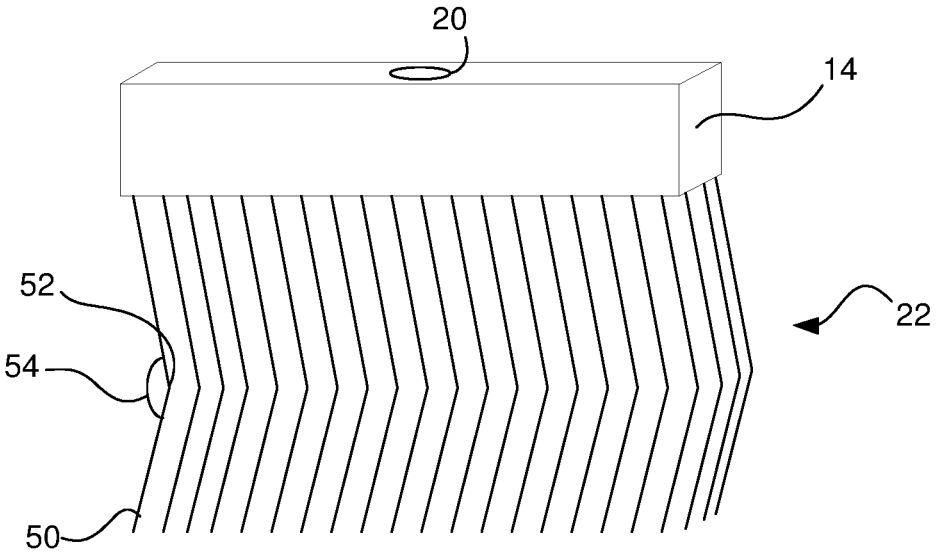
FIG. 8A is a perspective view of a broom head in accordance with an embodiment of the present disclosure.

As described above, the bristles may take various forms, for example, to increase the surface area of each bristle and/or to increase the interaction of bristles with adjacent bristles. For example, in one embodiment, as shown in FIGS. 7A and 8A, each bristle is a bent bristle configured to have one bend or multiple bends of a non-zero angle (e.g. in the range of about 110 degrees to about 170 degrees). As shown in FIG. 7A, a bristle 40 includes multiple bends 42 each configured at a non-zero angle 44. It is to be appreciated that a bristle may include any number of bends. For example, as shown in FIG. 8A, bristle 50 includes a single bend 52 at non-zero angle 54, e.g. angle 54 may be in the range of about 110 degrees to about 170 degrees.

In another embodiment, the head 14 may include a combination of different types of bristles to increase the interaction of bristles to enhance the releasing of the agent disposed on the bristles. For example, referring to FIG. 7B, head 14 includes at least one bristle 40 including multiple bends 42 and at least one substantially straight bristle 46. In use, for example when sweeping a surface such as a floor, bristles 40 will come into contact with bristles 46. The bends 42 of bristle 40 may come into contact at corresponding points of bristle 46 releasing at least one agent disposed at the corresponding points. It is to be appreciated that the bends 42 of bristle 40 may interact at various points along bristle 46 as the bends 42 may move side-to-side and up and down relative to bristle 46 enhancing the releasing of agents disposed on bristle 46.

Figure 8B:
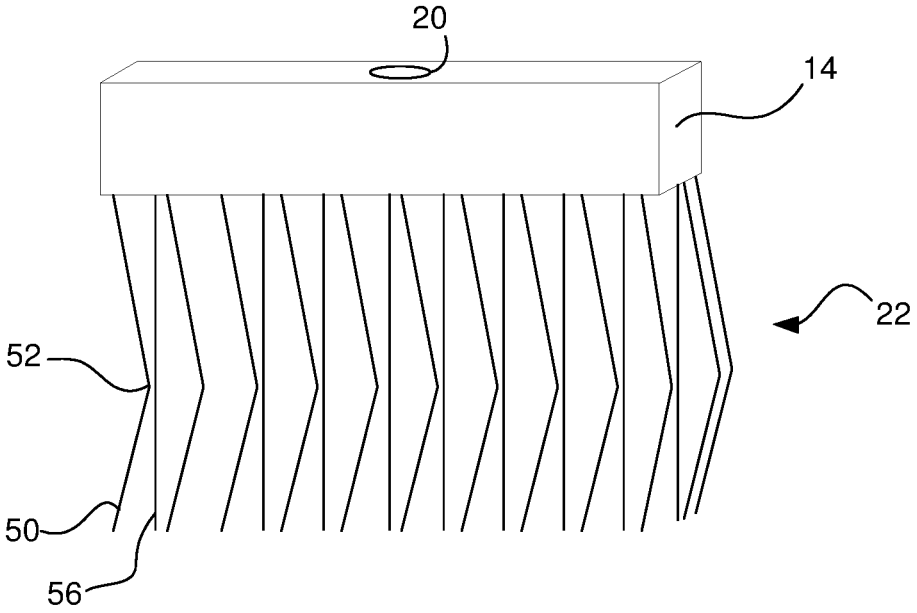
FIG. 8B is a perspective view of a broom head in accordance with an embodiment of the present disclosure.

In a further example, referring to FIG. 8B, head 14 includes at least one bristle 50 including at least one bend 52 and at least one substantially straight bristle 56. In use, for example when sweeping a surface such as a floor, bristles 50 will come into contact with bristles 56. The bend 52 of bristle 50 may come into contact at corresponding points of bristle 56 releasing at least one agent disposed at the corresponding points. It is to be appreciated that the bend 52 of bristle 50 may interact at various points along bristle 56 as the bend 52 may move side-to-side and up and down relative to bristle 56 enhancing the releasing of agents disposed on bristle 56.

Figure 9A:
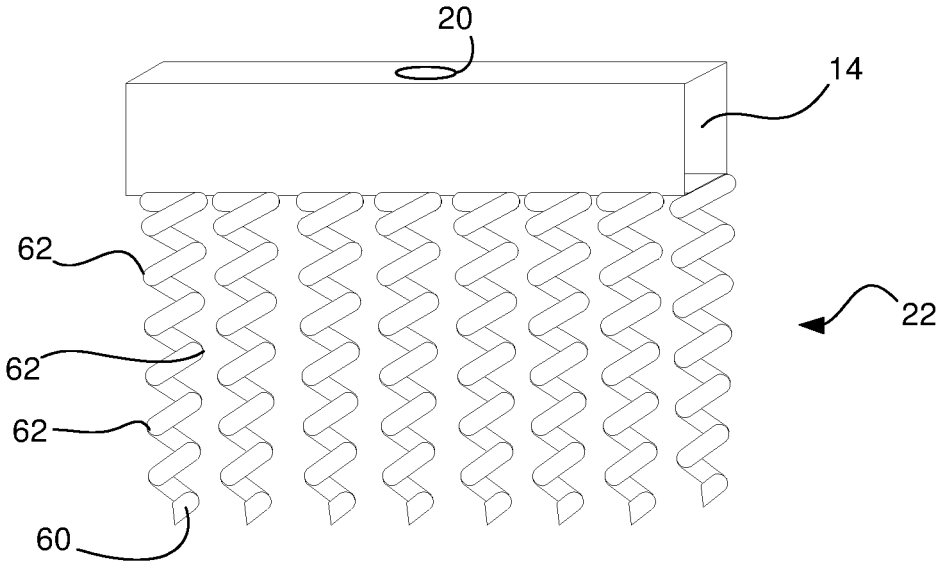
FIG. 9A is a perspective view of a broom head in accordance with an embodiment of the present disclosure.

In another embodiment, each bristle is helix or spiral shaped. As shown in FIG. 9A, head 14 includes a helix or spiral shaped bristle 60 including at least one turn 62. It is to be appreciated that bristle 60 may include any number of turns 62. Spiral bristles 60 will have an increased surface area for the disposition of agents as compared to straight bristles. Additionally, the turns 62 of the spiral bristles 60 will enhance contact between the bristles 60 enhancing the release of agents disposed on the bristles 60.

In another embodiment, the head 14 may include a combination of different types of bristles to increase the interaction of bristles to enhance the releasing of the agent disposed on the bristles. For example, referring to FIG. 9B, head 14 includes at least one bristle 60 including multiple turns 62 and at least one substantially straight bristle 66. In use, for example when sweeping a surface such as a floor, bristles 60 will come into contact with bristles 66. The turns 62 of bristle 60 may come into contact at corresponding points of bristle 66 releasing at least one agent disposed at the corresponding points. It is to be appreciated that the turns 62 of bristle 60 may interact at various points along bristle 66 as the turns 62 may move side-to-side and up and down relative to bristle 66 enhancing the releasing of agents disposed on bristle 66.

Figure 10:
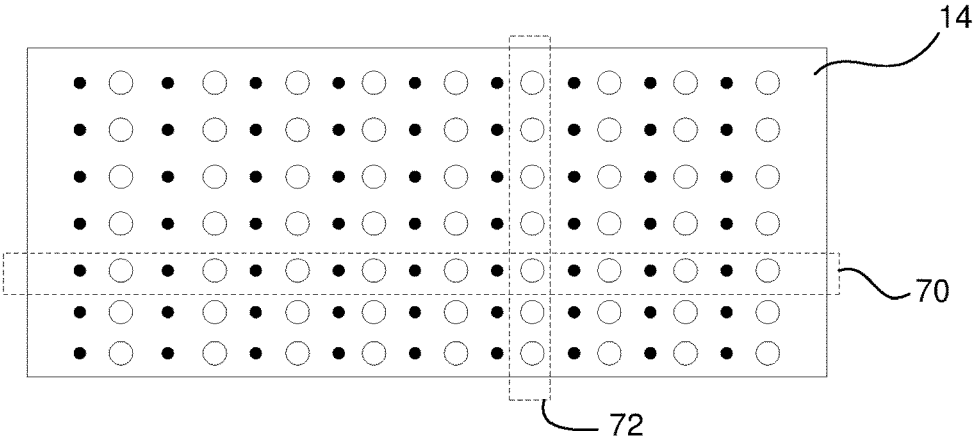
FIG. 10 is a bottom view of a broom head in accordance with an embodiment of the present disclosure.

In another embodiment, as shown in FIG. 10, the plurality of bristles may be split into rows 70 and columns 72. In this embodiment, every row 70 and/or column 72 may have alternating types of bristles. For example, referring to the embodiment of FIG. 7B, head 14 may include alternating columns 72 of multiple bend bristles 40 and substantially straight bristles 46. In this arrangement, each row 70 will include alternating types of bristles. In another example, referring to the embodiment of FIG. 8B, head 14 may include alternating columns 72 of single bend bristles 50 and substantially straight bristles 56. In the arrangement of FIG. 8B, each row 70 will include alternating types of bristles.

Figure 9B:
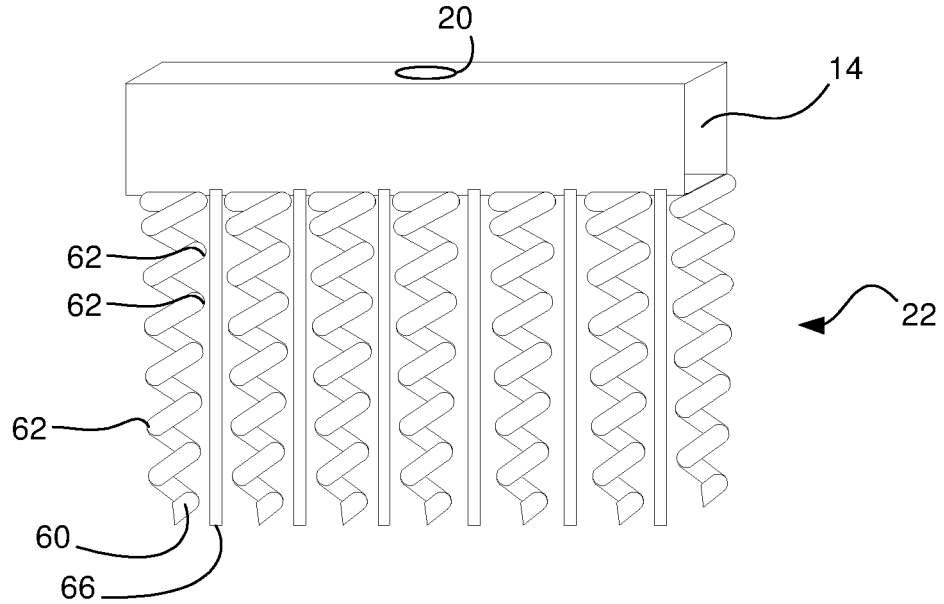
FIG. 9B is a perspective view of a broom head in accordance with an embodiment of the present disclosure.

In a further embodiment, every row 70 and column 72 may have alternating helix shaped bristles 60 and substantially straight bristles 66 as shown in FIG. 9B, or every row 70 and/or column 72 may have alternating clockwise and counterclockwise helix shapes.

It is to be appreciated that although the plurality of bristles are shown as a combination of alternating rows or columns of bent bristles and substantially straight bristles, or helix shaped bristles and substantially straight bristles, the plurality of bristles may be configured as any combination of bent bristles, helix shaped bristles and/or substantially straight bristles in any pattern without deviating from the scope of the present disclosure.

As shown in FIGS. 7A, 8A and 9A, increased contact between bristles is achieved by having helix shaped or bent bristles. Contact is also increased, as shown in FIGS. 7B, 8B, 9B and 10, with the plurality of bristles 22 configured as a combination of helix shaped bristles, bent bristles and/or straight bristles. Additionally, by having helix shaped bristles, bent bristles, or a combination of helix shaped bristles, bent bristles and/or straight bristles, the overall surface area of the plurality of bristles 22 is increased. The increase of overall surface area allows for more agent to be disposed on the plurality of bristles 22.

Figure 11:
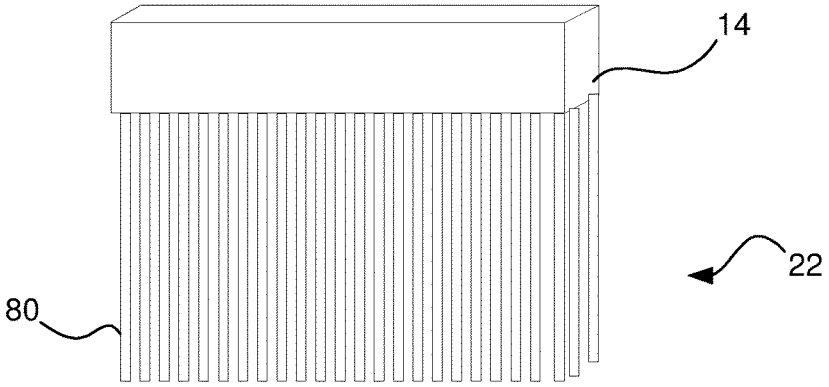
FIG. 11 is a perspective view of a broom head in accordance with an embodiment of the present disclosure.

In another embodiment, as shown in FIG. 11, the head 14 includes at least one substantially straight bristle 80. It is to be appreciated that the embodiment of FIG. 11 may be configured with the various agents described above via the various methods described above.

In another embodiment, the broom head 14 is interchangeable or replaceable. After the agent applied to the bristles 22 is exhausted, the handle 12 may be disengaged from the receiver 30 in the broom head 14 and the handle 12 may be coupled to a new or fresh broom head 14. Although a threaded type connection is illustrated for receiver 30, the present disclosure contemplated other types of devices and mechanisms for coupling and decoupling the broom head 14 to and from the handle 12, e.g., a quick-connect fitting, a snap-in connector, etc.

It is to be appreciated that broom head 14 may be configured in any shape (e.g., rectangular, circular, elliptical, etc.). Additionally, regardless of the shape of the broom head 14, the handle 12 may be coupled to the head 14 on any portion of the at least one surface 15. For example, as shown in FIG. 12, the handle 12 is coupled to receiver 20 in such a manner that the handle 12 is perpendicular to plurality of the bristles 22 to resemble a brush or the like. It is contemplated that various angles for coupling a handle to the head are to be within the scope of the present disclosure to achieve a configuration for a particular use.

It is to be appreciated that the various features shown and described are interchangeable, that is a feature shown in one embodiment may be incorporated into another embodiment.

While the disclosure has been shown and described with reference to certain preferred embodiments thereof, it will be understood by those skilled in the art that various changes in form and detail may be made therein without departing from the spirit and scope of the disclosure as defined by the appended claims.

Furthermore, although the foregoing text sets forth a detailed description of numerous embodiments, it should be understood that the legal scope of the invention is defined by the words of the claims set forth at the end of this patent. The detailed description is to be construed as exemplary only and does not describe every possible embodiment, as describing every possible embodiment would be impractical, if not impossible. One could implement numerous alternate embodiments, using either current technology or technology developed after the filing date of this patent, which would still fall within the scope of the claims.

It should also be understood that, unless a term is expressly defined in this patent using the sentence "As used herein, the term '_____' is hereby defined to mean_____" or a similar sentence, there is no intent to limit the meaning of that term, either expressly or by implication, beyond its plain or ordinary meaning, and such term should not be interpreted to be limited in scope based on any statement made in any section of this patent (other than the language of the claims). To the extent that any term recited in the claims at the end of this patent is referred to in this patent in a manner consistent with a single meaning, that is done for sake of clarity only so as to not confuse the reader, and it is not intended that such claim term be limited, by implication or otherwise, to that single meaning. Finally, unless a claim element is defined by reciting the word "means" and a function without the recital of any structure, it is not intended that the scope of any claim element be interpreted based on the application of 35 U.S.C. § 112, sixth paragraph.

What is claimed is:

1. A broom including:

an elongated handle having a first end and a second end;

a broom head including a receiver for coupling the broom head to the second end of the elongated handle and a plurality of bristles extending from the broom head; and an agent applied to at least one bristle of the plurality of bristles, wherein the agent is encapsulated by at least one of a membrane, wall and coating.

2. The broom of claim 1, wherein the agent is at least one of an antibacterial agent, a scented agent and a cleaning agent.

3. The broom of claim 2, wherein the agent is at least one of a liquid, solid, and gas.

4. The broom of claim 1, wherein at least two different agents are applied to the at least one bristle.

5. The broom of claim 4, wherein the at least two different agents are each separately applied to each of the at least one bristle in different regions.

6. The broom of claim 1, wherein at least one bristle of the plurality of bristles is straight.

7. The broom of claim 1, wherein at least one bristle of the plurality of bristles includes an elongated member and at least one side member coupled to and extending away from the elongated member.

8. The broom of claim 7, wherein at least one second bristle of the plurality of bristles is straight.

9. The broom of claim 8, wherein the at least one elongated member bristle with the at least one side member bristle and the at least one second straight bristle are arranged in alternating rows and columns.

10. The broom of claim 1, wherein at least one bristle of the plurality of bristles is helix shaped.

11. The broom of claim 10, wherein at least one second bristle of the plurality of bristles is straight.

12. The broom of claim 11, wherein the at least one helix shaped bristle and the at least one second straight bristle are arranged in alternating rows columns.

13. The broom of claim 1, wherein at least one bristle of the plurality of bristles includes at least one bend of a non-zero angle.

14. The broom of claim 13, wherein at least one second bristle of the plurality of bristles is straight.

15. The broom of claim 14, wherein the at least one bristle including the at least one bend and the at least one second straight bristle are arranged in alternating rows and columns.

16. The broom of claim 13, wherein the at least one bend of the non-zero angle is in the range of 110 degrees to 170 degrees.

17. The broom of claim 16, wherein the at least one bristle includes a plurality of bends.

18. A broom including:

an elongated handle having a first end and a second end;

a broom head including a receiver for coupling the broom head to the second end of the elongated handle and a plurality of bristles extending from the broom head; and an agent applied to at least one bristle of the plurality of bristles, wherein at least some bristle of the plurality of bristles includes an elongated member having a first end coupled to the broom head and a second, free end configured to make contact with a surface to be cleaned and a plurality of side members coupled to the elongated member along a length between the first end and second, free end, the plurality of side members extending away from the elongated member wherein the plurality of side members are configured to contact each other to release the agent to the surface to be cleaned.

19. The broom of claim 18, wherein the agent is at least one of an antibacterial agent, a scented agent and a cleaning agent.

20. A broom including:

an elongated handle having a first end and a second end;

a broom head including a receiver for coupling the broom head to the second end of the elongated handle and a plurality of bristles extending from the broom head, each of the plurality of bristles is spiral shaped including a plurality of turns; and an agent applied to at least one bristle of the plurality of bristles, wherein the turns of the plurality of spiral bristles are configured to enhance contact between the bristles causing the release of the agent disposed on the at least one bristle when the bristles interact.

* * * * *